US007683801B2

(12) United States Patent
Winarski

(10) Patent No.: US 7,683,801 B2
(45) Date of Patent: Mar. 23, 2010

(54) MULTICOLOR VISUAL FEEDBACK FOR PORTABLE, NON-VOLATILE STORAGE

(76) Inventor: Tyson York Winarski, 428 E. Susan La., Tempe, AZ (US) 85281

( * ) Notice: Subject to any disclaimer, the term of this patent is extended or adjusted under 35 U.S.C. 154(b) by 220 days.

(21) Appl. No.: 11/754,333

(22) Filed: May 28, 2007

(65) Prior Publication Data

US 2008/0297368 A1 Dec. 4, 2008

(51) Int. Cl.
*G08B 5/00* (2006.01)

(52) U.S. Cl. ..... 340/815.4; 340/815.45; 340/815.52; 340/815.65; 362/800

(58) Field of Classification Search ..... 340/815.43, 340/815.45, 815.49, 815.52, 815.65; 362/800
See application file for complete search history.

(56) References Cited

U.S. PATENT DOCUMENTS 6,653,799 B2 * 11/2003 Cammack ..... 315/224
7,161,311 B2 * 1/2007 Mueller et al. ..... 315/294
7,242,152 B2 * 7/2007 Dowling et al. ..... 315/291
7,511,437 B2 * 3/2009 Lys et al. ..... 315/307
2002/0077810 A1 * 6/2002 Swinney ..... 704/201
2003/0095052 A1 * 5/2003 Dechape ..... 340/908
2007/0165555 A1 * 7/2007 Deng et al. ..... 370/318
2007/0168396 A1 * 7/2007 Adams et al. ..... 707/200
2007/0279377 A1 * 12/2007 Hillis et al. ..... 345/107

* cited by examiner

*Primary Examiner*—Daniel Wu
*Assistant Examiner*—Rufus Point
(74) *Attorney, Agent, or Firm*—The Winarski Firm

(57) ABSTRACT

An improved portable storage device is disclosed having an interface, a controller in communication with this interface, a memory in communication with the controller, and a light-emitting-diode assembly in communication with the controller. The light-emitting-diode assembly has a first and a second light-emitting-diode element, the first and second light-emitting-diode elements emitting a first and a second color of light, respectively. The first light-emitting-diode element and said second light-emitting-diode element each independently controlled by the controller via pulse-width-modulation, to produce a third color which appears to be in between the first and second colors in wavelength, this third color indicative of the percent completion of an I/O task or the usage of the memory.

18 Claims, 3 Drawing Sheets

MULTICOLOR VISUAL FEEDBACK FOR PORTABLE, NON-VOLATILE STORAGE

FIELD OF THE INVENTION

The present invention relates to the field of multicolor visual feedback for portable, non-volatile storage devices.

BACKGROUND OF THE INVENTION

Traditional portable non-volatile storage devices, such as USB storage devices commonly referred to as "thumb drives" or MP3 players, have a single-color light-emitting-diode, which is toggled on and off by an internal controller. This single-color light-emitting-diode gives no differentiation between reading data to, or writing data from, the thumb drive. Furthermore, this LED gives no indication whether the memory is full or whether there is a problem with the thumb drive.

SUMMARY OF THE INVENTION

The present invention provides multicolor visual feedback for portable solid state storage devices. For example, one color is used to indicate read operations, another indicates write operations, and yet another color indicates either I/O problems or a memory full condition.

The present invention also provides a progression of color from the multicolor visual feedback to indicate the used capacity of the portable, non-volatile storage.

The present invention also provides a progression of color from the multicolor visual feedback to indicate the percent completion of an I/O job writing to or reading from the portable, non-volatile storage.

Further aspects of the invention will become apparent as the following description proceeds and the features of novelty which characterize this invention are pointed out with particularity in the claims annexed to and forming a part of this specification.

BRIEF DESCRIPTION OF THE DRAWINGS

The novel features that are considered characteristic of the invention are set forth with particularity in the appended claims. The invention itself; however, both as to its structure and operation together with the additional objects and advantages thereof are best understood through the following description of the preferred embodiment of the present invention when read in conjunction with the accompanying drawings, wherein:

DESCRIPTION OF THE PREFERRED EMBODIMENTS

While the invention has been shown and described with reference to a particular embodiment thereof, it will be understood to those skilled in the art, that various changes in form and details may be made therein without departing from the spirit and scope of the invention.

Figure 1:
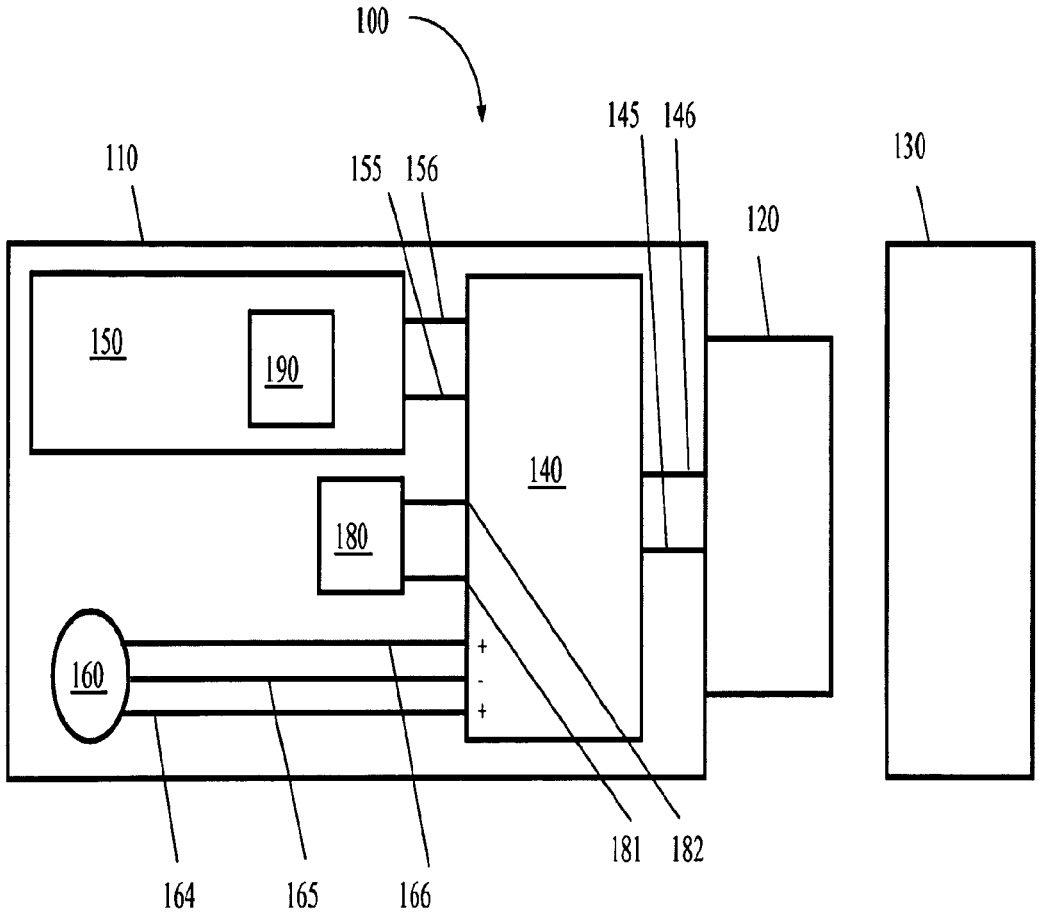
FIG. 1 shows a block-diagram of a USB storage device.

FIG. 1 shows a block diagram of portable storage device 100 which has exterior case 110 and removable end-cap 130. End-cap 130 protects interface 120. Interface 120 communicates with a mating interface in a laptop, notebook, or desktop computer (not shown) for the transfer of data. Interface 120 is typically a USB interface. However, interface 120 could alternately be a SCSI (Small Computer System Interface), iSCSI (Internet SCSI, where SCSI commands are embedded into a different protocol such as Ethernet), Ethernet, Fibre Channel, Serial Attached SCSI (SAS), Serial ATA (SATA, or Serial Advanced Technology Attachment), IDE (Integrated Drive Electronics), TCP/IP (Transmission Control Protocol/Internet Protocol), or Bluetooth interface.

Exterior case 110 protects electrical components: controller 140, memory 150, multicolor light-emitting-diode (LED) assembly 160, and crystal oscillator 180. Controller 140 and interface 120 share one or more data flow lines 145 and one or more electrical power lines 146. Controller 140 and memory 150 share one or more data flow lines 155 and one or more electrical power lines 156. Controller 140 and crystal oscillator 180 share clock-in line 181 and clock-out line 182.

Crystal oscillator 180 oscillates in the MegaHertz range, for example 6 MHz, and its timing pulses are used to regulate the activity of controller 140 and the data flow in and out of memory 150.

Memory 150 can be a solid-state EEPROM (Electrically Erasable Programmable Read Only Memory), which is a nonvolatile memory so that data stored in memory 150 is retained after storage device 100 is detached from its host, such as a laptop, notebook, or desktop computer, and power is no longer provided to storage device 100. It is the use of EEPROM which gives the portability to the thumb drive without need of a battery inside of storage device 100. A special type of solid-state EEPROM is Flash memory, where data is written, read, or erased in blocks, rather than by individual bytes. Because of the inherent efficiency of this block-level access, Flash memory is the preferred rewritable solid-state memory for memory 150. Alternately, memory 150 could be a solid-state PROM (programmable read only memory) which is written only once, but can be read any number of times. Random Access Memory is unsuitable for memory 150, as that memory completely loses its stored data when no longer supplied with power.

An alternative to using an EEPROM, Flash, or PROM for memory 150 is publicly known as Millipede, which is based on Micro-Electrical-Mechanical-Systems (MEMS) components borrowed from Atomic Force Microscopy (AFM). Tiny depressions which are created with an AFM tip in a polymer medium represent stored data bits. This AFM tip is typically a microscopic cantilevered beam with a nano-sized indenter at the end. These stored bits in the polymer medium are non-volatile and can later be read back by the same AFM tip. Data written in this way can also be erased using the same AFM tip, and the polymer medium can be reused thousands of times. This thermo-mechanical storage technique is the nano-mechanical equivalent of the punched card of the 1900's, and it is capable of achieving data densities exceeding 1 Terabit per square-inch, well beyond the expected limits of magnetic recording. One Terabit is a million-million bits, and 1 Terabit per square inch is equivalent to 155 Gigabits per square-centimeter. Use of a millipede chip for memory 150 in storage device 100 could enable a thumb drive to hold approximately 20 Gigabytes of data.

Although the read-back rate of an individual probe is limited, high data rates can still be achieved by making use of massive parallelism of an array of probes. An array consisting of thousands of thermo-mechanical probes can operate in a highly parallel manner, with each individual probe capable of reading, writing and erasing data in its own small storage field. The read- and write-array can be fabricated as a single memory chip 150, using well-established, low-cost semiconductor micro-fabrication techniques.

Controller 140 and memory 150 could be separate chips, as illustrated in FIG. 1, or integrated into a single chip in order to reduce interconnections such as one or more data flow lines 155 and one or more electrical power lines 156.

Figure 2:
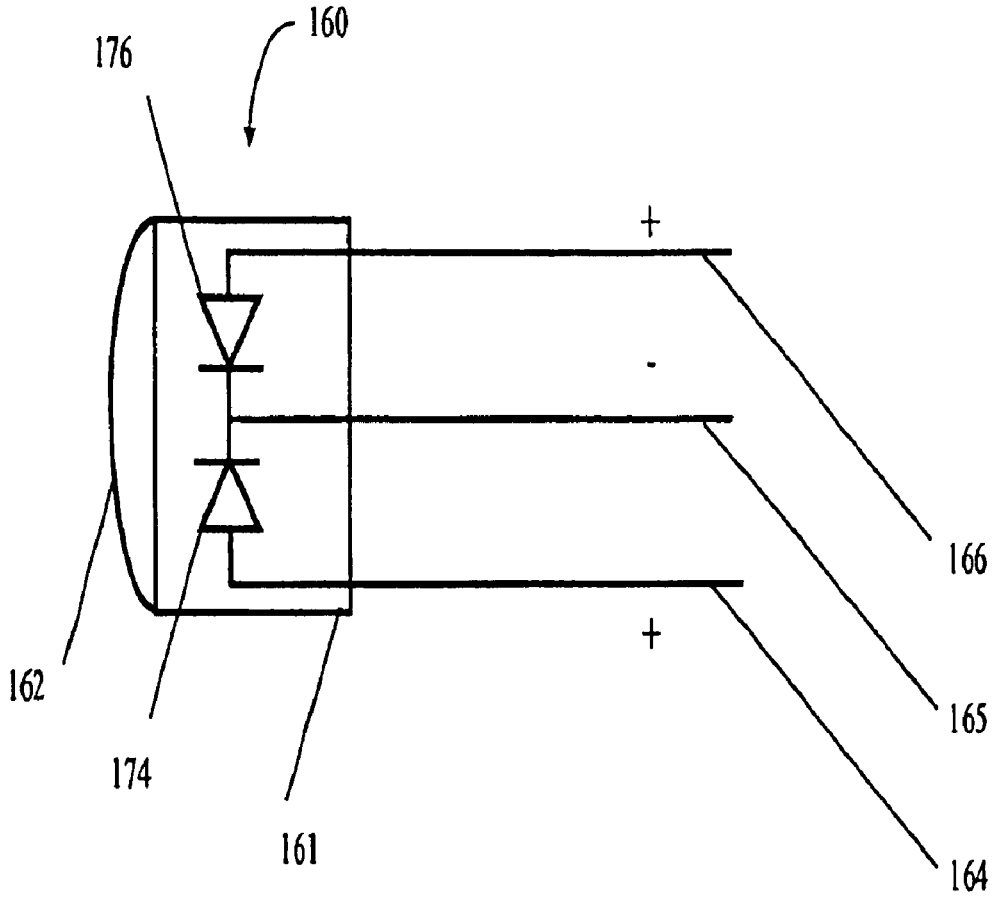
FIG. 2 shows a side view of a cross-section of a multicolor light-emitting-diode assembly.

Referring to FIGS. 1-2, LED assembly 160 is connected to controller 140 via common cathode 165, red anode 164, and green anode 166. One LED assembly 160 contains both a red LED element 174 and a greed LED element 176 within case 161. Top cover 162 of LED assembly 160 is where the light exits. Top cover 162 may be a lens, such as a convex lens or a Fresnel lens. Red LED element 174 is connected to red anode 164 and common cathode 165. Greed LED element 176 is connected to green anode 166 and common cathode 165. To make LED assembly 160 glow green, controller 140 directs electric current through green anode 166, through green LED element 176, to common cathode 165. To make LED assembly 160 glow red, controller 140 directs electric current through red anode 164, through red LED element 174, to common cathode 165.

An example of LED assembly 160 is HLMP-4000 and HLMP-0800 manufactured by Hewlett Packard. Examples of USB controllers are PS2045 by PHISON and i5062-ZD by iCreate Technologies, but presently, both of these controllers only have a single cathode and anode line to control single-color LED, and both controllers would have to be modified to have electrical ports for common cathode 165, red anode 164, and green anode 166.

TABLE 1

Wavelengths of Visible Light

| Color | Range of Wavelength in nanometers |
|---|---|
| Violet | 400-424 nm |
| Blue | 424-491 nm |
| Green | 491-575 nm |
| Yellow | 575-585 nm |
| Orange | 585-647 nm |
| Red | 647-700 nm |

Figure 3:
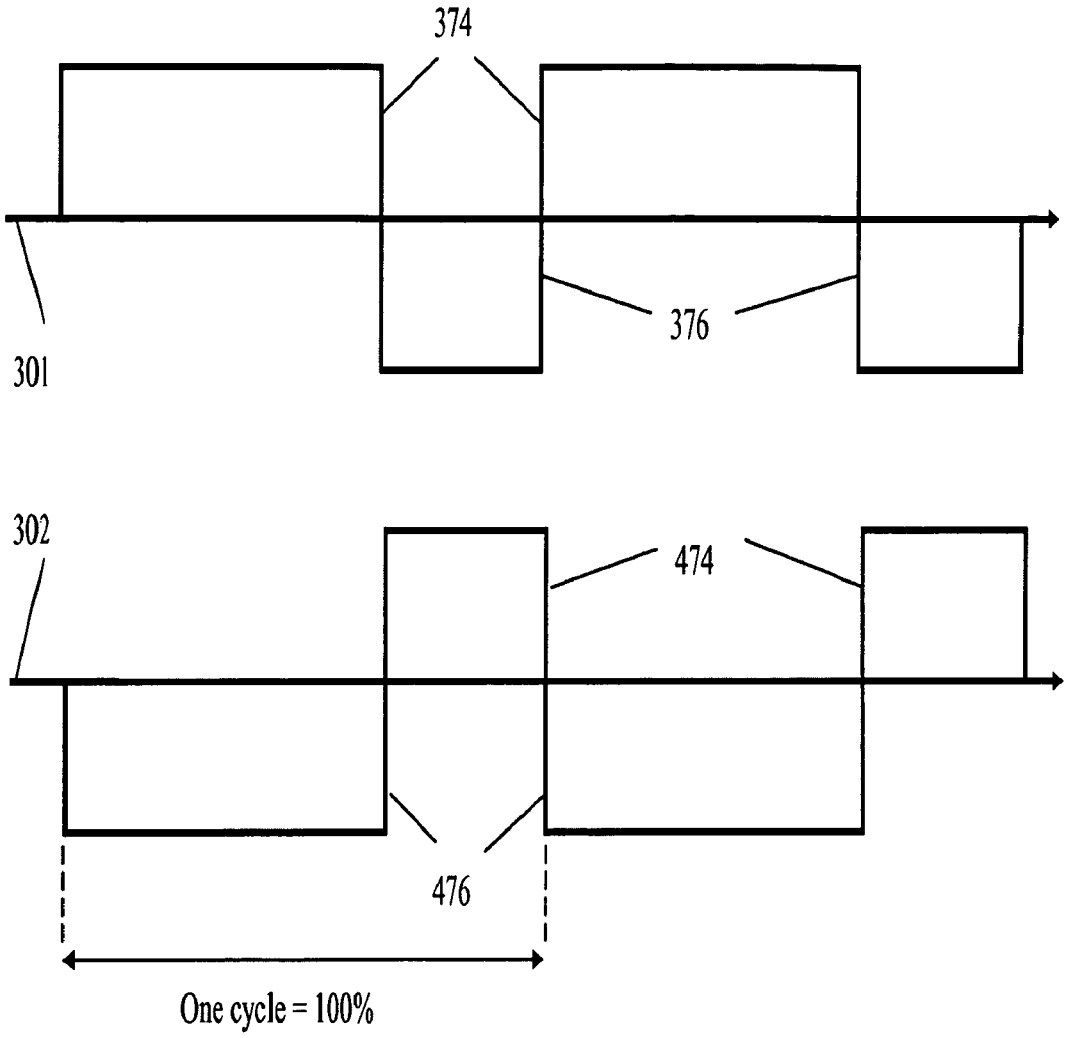
FIG. 3 shows pulse-width-modulation of the multicolor light-emitting-diode assembly.

Table 1 shows color versus wavelengths of light. Referring to both Table 1 and FIG. 3, LED assembly 160 will appear to glow orange along timeline 301, to the human eye, if red LED element 174 is electrically pulse-width-modulated with a duty cycle 374 of about 60-70% and green LED element 176 with a duty cycle 376 of about 40-30%, and when one LED element is illuminated, the other LED element is not. In this regard, as shown in FIG. 3, one complete red-green cycle is deemed to be 100%. LED assembly 160 will appear to glow yellow along timeline 302, to the human eye, if red LED element 174 is electrically pulse-width-modulated with a duty cycle 474 of about 30-40% and green LED element 176 with a duty cycle 476 of about 70-60%, and when one LED element is illuminated, the other LED element is not. This alternating pulse-width-modulation of the fundamental colors of red and green is superimposed by the human eye to appear as the intermediary colors of orange or yellow, even though neither orange nor yellow light is actually produced by LED assembly 160. Other color combinations are possible if different LED elements are used. For example, if LED element 174 produces yellow light and LED element 176 produces blue light, pulse-width-modulating these two elements each with a duty cycle of 50% will produce light which appears to be green to the human eye. LED elements 174 and 176 are typically illuminated with identical direct-current (DC) voltages; however, LED elements 174 and 176 may be driven with different DC voltages, if the illumination intensities of LED elements 174 and 176 vary.

This pulse-width-modulation of LED assembly 160 occurs at a frequency of at least 30 Hertz (Hz), which is the frequency at which television screens are refreshed in the United States. This frequency of pulse-width-modulation is the number of red-green cycles in one second, meaning that at 30 Hz, there are 30 red-green pulse-width-modulated cycles in one second. A higher frequency of pulse-width-modulation may be desirable, such as 100-1000 Hz. Controller 140 establishes the pulse-width-modulation of LED assembly 160 via alternately sending electrical current to red anode 164 or green anode 166, and then receiving that current across common cathode 165. Thus, controller 140 determines whether LED assembly 160 appears to the human eye as red (100% red, 0% green), orange (60-70% red, 40-30% green), yellow (30-40% red, 70-60% green), or green (0% red, 100% green).

LED assembly 160 can be controlled by controller 140 to appear as red for indicating read operations from memory 150, green for indicating write operations to memory 150.

Alternately, LED assembly 160 can be pulse-width-modulated by controller 140 based on what percent that memory 150 is filled with data, where the percent memory filled is denoted by X. For example, the pulse-width-modulation could be given by eqn. (1A).

$$(\text{Red},\text{Green})=(X\%,[100-X]\%) \qquad \text{eqn. (1A)}$$

$$(\text{Green},\text{Red})=(X\%,[100-X]\%) \qquad \text{eqn. (1B)}$$

With eqn. (1A), I/O storage device 100 with an empty or nearly empty memory 150 would be indicated by green light from LED assembly 160. As memory 150 fills and X increases in magnitude, the light from LED assembly 160 would appear to go from green to yellow, from yellow to orange, to finally from orange to red. Red light from LED assembly 160 could indicated that memory 150 was filled or nearly filled. Similarly, with eqn. (1A), as data is erased from memory 150, light from LED assembly 160 would appear to go from red to orange, from orange to yellow, to finally from yellow to green, as all or nearly all data were being erased from memory 150.

Alternately, with eqn. (1B), I/O storage device 100 with an empty or nearly empty memory 150 would be indicated by red light from LED assembly 160. As memory 150 fills and X increases in magnitude, the light from LED assembly 160 would appear to go from red to orange, from orange to yellow, and then from yellow to green. Green light from LED assembly 160 could indicated that memory 150 was filled or nearly filled. Similarly, with eqn. (1B), as data is erased from memory 150, light from LED assembly 160 would appear to go from green to yellow, from yellow to orange, to finally from orange to red, as all or nearly all data were being erased from memory 150.

Thus, implementing either eqn. (1A) or eqn. (1B) by controller 140 would give a visual indication of the percentage of memory 150 which is filled with data by use of a single multi-color LED assembly 160.

Eqn. (1A) and eqn. (1B) could also be applied to individual logical partitions of memory 150. A logical partition of memory 150 is the equivalent of partitioning a hard disk drive into a C: and D: drive on a laptop, notebook, or desktop computer. Then, eqn. (1A) can be applied to what partition of memory is currently being accessed, by controller 140. Assuming that eqn. (1A) is used, it is interesting to note that one logical partition of memory 150 could be completely filled with data and per eqn. (1A) and LED 160 would show as red for I/O to the filled partition, while other logical partitions of memory 150 could have available capacity and LED 160 could appear as giving green, yellow, or orange light for I/O to the unfilled logical partitions.

Still other visual embodiments are possible. For example, flashing orange or yellow could indicate an I/O problem. Other color and sequencing combinations are possible, such as eqn. (2A), where the percentage P of the size of the file to be read or written is used by controller 140 to pulse-width-modulate LED assembly 160.

$$(\text{Red,Green})=(P\%,[100-P]\%) \quad \text{eqn. (2A)}$$

$$(\text{Green,Red})=(P\%,[100-P]\%) \quad \text{eqn. (2B)}$$

In Eqn. (2A), LED assembly 160 glows green when the I/O job first starts. As the job progresses and the percentage P of the I/O job completed increases, the color of light which appears to be coming from LED assembly 160 changes from green to yellow, from yellow to orange, and then from orange to red, as the I/O job is completed. Percentage P is measured by controller 140 as the total number of megabytes of data written or read so far, divided by the total number of megabytes of data in the write or read job. So, when the job starts, P=0% and the light is all green from LED assembly 160, and when the job concludes, P=100% and the light is all red from LED assembly 160. When percentage P is between 0% and 100%, the light from LED assembly 160 would appear to change from green to yellow, from yellow to orange, and then from orange to red, as percentage P increases towards 100%.

Alternately, in eqn. (2B), LED assembly 160 glows red when the I/O job first starts. As the job progresses and the percentage P of the I/O job completed increases, the color of light which appears to be coming from LED assembly 160 changes from red to orange, from orange to yellow, and then from yellow to green, as the I/O job is completed. When the job starts, P=0% and the light is all red from LED assembly 160, and when the job concludes, P=100% and the light is all green from LED assembly 160. When percentage P is between 0% and 100%, the light from LED assembly 160 would appear to change from red to orange, from orange to yellow, and then from yellow to green, as percentage P increases towards 100%.

A portion 190 of memory 150, FIG. 1, can be used to store the user's selection as to whether eqn. (1A), eqn. (1B), eqn. (2A), or eqn. (2B) is applied by controller 140 to LED assembly 160. The user makes his or her choice at the host level, such as a laptop or notebook, and then stores that choice in memory portion 190. Controller then accesses memory portion 190 and pulse-width-modulates LED assembly 160 accordingly. Other control algorithms are possible.

While the invention has been shown and described with reference to a particular embodiment thereof, it will be understood to those skilled in the art, that various changes in form and details may be made therein without departing from the spirit and scope of the invention.

What I claim is:

1. A portable storage device, comprising:

an interface, a controller in communication with said interface, a memory in communication with said controller, and a light-emitting-diode assembly in communication with said controller, said light-emitting-diode assembly comprising:

a first and second light-emitting-diode element, said first light-emitting-diode element emitting a first color of light and said second light-emitting-diode element emitting a second color of light, said second color of light being of a different wavelength than said first color of light, said first light-emitting-diode element and said second light-emitting-diode element each independently controlled by said controller, said controller configured to pulse-width-modulate said first light-emitting-diode element and said second light-emitting-diode element to emit light that appears to the human eye to be of an intermediate color which has a wavelength between said first color and said second color, said controller configured to vary the wavelength of light emitted by said light-emitting-diode assembly between said first color and said second color in direct correlation to a percentage related to data storage of said memory, said first color corresponding to a first percentage, said second color corresponding to a second percentage, said intermediate color corresponding to an intermediate percentage between the first and second percentages.

2. The portable storage device of claim 1, wherein the wavelength of said intermediate color corresponds to a specific intermediate percentage between 0 and 100 percent.

3. The portable storage device of claim 2, wherein the wavelength of said intermediate color can be varied continuously between said first color and said second color to visually indicate different percentages between 0 and 100 percent.

4. The portable storage device of claim 1, wherein said controller is configured to continuously vary the wavelength of said intermediate color between the wavelength of said first color and said second color such that the percentage related to data storage is indicated visually continuously between 0 and 100 percent by the wavelength of light emitted by the light-emitting-diode assembly.

5. The portable storage device of claim 1, wherein the percentage related to data storage of said memory is a percent completion of an I/O operation performed with said portable storage device, wherein the wavelength of light emitted by said light-emitting-diode assembly varies continuously between the first color and the second color as the percentage completion of said I/O operation varies continuously between 0 percent complete and 100 percent complete, such that an intermediate percentage of completion between 0 percent and 100 percent of said I/O operation is indicated by said intermediate color.

6. The portable storage device of claim 2, wherein the percentage related to data storage of said memory is a percentage of a file size that has been written to or read from said memory, wherein said controller continuously varies the color of light emitted by said light-emitting-diode assembly between said first color and said second color by pulse-width-modulation according to the equation: (first color, second color)=(P %, [100−P]%), such that the color of the light between the first and second colors corresponds to a specific percentage between 0 and 100 percent, wherein P is a percentage of the size of the file that has actually been read from or written to said memory, such that an intermediate percentage of completion between 0 percent and 100 percent of said I/O operation is indicated by said intermediate color.

7. The portable storage device of claim 1, wherein the percentage related to data storage of said memory is a percentage that said memory is filled with data, wherein the wavelength of light emitted by said light-emitting-diode assembly varies continuously between the first color and the second color as the percentage that said memory is filled with data varies continuously between 0 percent complete and 100 percent complete, such that an intermediate percentage of completion between 0 percent and 100 percent of said memory being filled with data is indicated by said intermediate color.

8. The portable storage device of claim 1, wherein the percentage related to data storage of said memory is a percentage that said memory is filled with data, wherein said controller continuously varies the color of light emitted by said light-emitting-diode assembly between said first color and said second color by pulse-width-modulation with the equation: (first color, second color)=(X%, [100−X]%), such that the color of the light between the first and second colors corresponds to a specific percentage between 0 and 100 percent, wherein X is a percentage of said memory that is filled with data such that an intermediate percentage between 0 and 100 percent of said memory being filled with data is visually indicated by said intermediate color.

9. A storage device, comprising:

an interface, a controller in communication with said interface, a memory in communication with said controller, and a light-emitting-diode assembly in communication with said controller, said light-emitting-diode assembly configured to emit different wavelengths of light within a spectrum of light, wherein said spectrum represents a range of percentages related to data storage of said memory, wherein each wavelength of light within said spectrum represents a different percentage within said range of percentages.

10. The storage device of claim 9, wherein said light-emitting-diode assembly continuously varies the wavelength of light emitted within said spectrum in directly correlation to a continuously changing percentage value related to data storage of said memory.

11. The storage device of claim 9, wherein the percentage related to data storage of said memory is a percent completion of an I/O operation performed to said portable storage device.

12. The storage device of claim 9, wherein the percentage related to data storage of said memory is a percentage of a file size that has been written to or read from said memory.

13. The storage device of claim 9, wherein the percentage related to data storage of said memory is a percentage that said memory is filled with data.

14. The storage device of claim 10, wherein said light-emitting-diode assembly comprises a first and second light-emitting-diode element, said first light-emitting-diode element emitting a first color of light and said second light-emitting-diode element emitting a second color of light, said second color of light being of a different wavelength than said first color of light, said first light-emitting-diode element and said second light-emitting-diode element each independently controlled by said controller, said controller configured to pulse-width-modulate said first light-emitting-diode element and said second light-emitting-diode element to emit light that appears to the human eye to be of an intermediate color which has a wavelength between said first color and said second color, wherein the direct correlation between the light emitted by said light-emitting diode assembly and said percentage is given by the pulse-width-modulation equation: (first light-emitting-diode, second light-emitting-diode)=(P %, [100−P]%), wherein P is a specific percentage value related to data storage of said memory.

15. A portable storage device, comprising:

an interface, a controller in communication with said interface, a memory in communication with said controller, and a light-emitting-diode assembly in communication with said controller, said light-emitting-diode assembly comprising:

a first and second light-emitting-diode element, said first light-emitting-diode emitting a first color of light and said second light-emitting-diode element emitting a second color of light, said second color of light being of a different wavelength than said first color of light, said first light-emitting-diode element and said second light-emitting-diode element each independently controlled by said controller, said controller configured to pulse-width-modulate said first light-emitting-diode element and said second light-emitting-diode element to emit light that appears to the human eye to be of an intermediate color which has a wavelength between said first color and said second color, wherein said controller is configured to continuously vary the wavelength of said intermediate color between the wavelength of said first color and said second color such that a percentage related to data storage is indicated visually continuously between 0 and 100 percent by the wavelength of light emitted by the light-emitting-diode assembly.

16. The portable storage device of claim 15, wherein the percentage related to data storage of said memory is a percent completion of an I/O operation performed with said portable storage device, wherein the wavelength of light emitted by said light-emitting-diode assembly varies continuously between the first color and the second color as the percentage completion of said I/O operation varies continuously between 0 percent complete and 100 percent complete, such that an intermediate percentage of completion between 0 percent and 100 percent of said I/O operation is indicated by said intermediate color.

17. The portable storage device of claim 15, wherein the percentage related to data storage of said memory is a percentage of a file size that has been written to or read from said memory, wherein said controller continuously varies the color of light emitted by said light-emitting-diode assembly between said first color and said second color by pulse-width-modulation according to the equation: (first color, second color)=(P %, [100−P]%), such that the color of the light between the first and second colors corresponds to a specific percentage between 0 and 100 percent, wherein P is a percentage of the size of the file that has actually been read from or written to said memory, such that an intermediate percentage of completion between 0 percent and 100 percent of said I/O operation is indicated visually by said intermediate color.

18. The portable storage device of claim 15, wherein the percentage related to data storage of said memory is a percentage that said memory is filled with data, wherein the wavelength of light emitted by said light-emitting-diode assembly varies continuously between the first color and the second color as the percentage that said memory is filled with data varies continuously between 0 percent complete and 100 percent complete, such that an intermediate percentage of completion between 0 percent and 100 percent of said memory being filled with data is indicated by said intermediate color.

* * * * *